US006319174B1

(12) United States Patent
Alexander

(10) Patent No.: US 6,319,174 B1
(45) Date of Patent: Nov. 20, 2001

(54) SOFT-EDGED RECREATIONAL TRAMPOLINE

(76) Inventor: Keith Vivian Alexander, 65 Middleton Road, Christchurch (NZ)

( * ) Notice: Subject to any disclaimer, the term of this patent is extended or adjusted under 35 U.S.C. 154(b) by 0 days.

(21) Appl. No.: 09/695,829

(22) Filed: Oct. 26, 2000

(30) Foreign Application Priority Data

Nov. 2, 1999 (NZ) ..... 500734

(51) Int. Cl.[7] ..... A63B 5/11

(52) U.S. Cl. ..... 482/27; 482/28; 482/29; 482/30

(58) Field of Search ..... 482/27, 28, 29, 482/30

(56) References Cited

U.S. PATENT DOCUMENTS 4,836,530 * 6/1989 Stanley, Jr. ..... 272/65
4,880,226 * 11/1989 Krantz ..... 272/97

* cited by examiner

*Primary Examiner*—Jerome W. Donnelly
*Assistant Examiner*—Lori Baker Amerson
(74) *Attorney, Agent, or Firm*—Ross, Ross & Flavin

(57) ABSTRACT

A trampoline which incorporates a flexible mat supported above a support frame by a number of spaced flexible rods; each rod is secured at one end to the mat and at the other end to the support frame.

13 Claims, 5 Drawing Sheets

SOFT-EDGED RECREATIONAL TRAMPOLINE

TECHNICAL FIELD

The present invention relates generally to a trampoline for sporting and/or recreational use and particularly to a soft-edged trampoline without any exposed springs adjacent to the bouncing surface.

BACKGROUND ART

Despite a high degree of popularity and widespread use in homes, schools, parks and other public/holiday environments, the use of trampolines has been shown to incur an alarming accident/injury rate. As the overwhelming majority of injuries occur in domestic situations (i.e. non-public, household environments), any improvement in the intrinsic passive safety of the trampoline design would have significant advantages.

The design of conventional trampolines (circular, octagonal, or rectangular) incorporates a peripheral exterior metal frame with an interposed mat tensioned within the plane of the frame by conventional extension springs spaced about the edge of the mat and attached to the frame. This configuration leads to the springs being in the same plane as the bouncing surface of the mat, with the attendant risk that the user will land on the springs (and/or the gaps between springs) instead of the mat. Use of additional protective covers over the upper surface of springs minimises, but does not eliminate, the risk of injury. Moreover, the frame itself provides a non-yielding surface that can also cause injury to the user in the event of a wayward landing. Similar injuries are possible through impacts with the side of trampoline, e.g. inadvertent collisions from children engaged in (and distracted by) other garden activities such as rugby and so forth.

Whilst overcoming or reducing the aforesaid disadvantages is obviously desirable, any effective alternative to conventional trampolines must provide comparable performance in terms of the bouncing characteristics.

DISCLOSURE OF INVENTION

It is therefore an object of the present invention to substantially ameliorate the aforesaid disadvantages by the provision of an improved trampoline.

It is a further object of the present invention to provide a trampoline which may be easily assembled and disassembled with the minimum of tools.

The present invention provides a trampoline including

- a flexible mat with a plurality of first retaining means located around the mat perimeter,
- a plurality of second retaining means located about the periphery of a support element and
- a plurality of flexible elongated rods, such that in use on a flat horizontal surface, said mat forms a horizontal plane having an upper contact surface and a lower non-contact surface orientated vertically above said support element, wherein each said flexible rod is retained at a first and second end by said first and second retaining means respectively.

Preferably, each said rod extends upwards from said ring frame at an incline.

Preferably, the said rods are simultaneously inclined from said support element to intersect with the said mat perimeter at a non-orthogonal angle in both the vertical and horizontal planes.

Preferably, said mat is circular or polygonal.

Preferably, said support element is a annular frame orientated concentrically below said mat in use. The diameter of said mat preferably exceeds the said base, such that in use the trampoline forms an inverted substantially frustro-conical shape.

Preferably, said first retaining means comprises a plurality of pockets/pouches each formed with an aperture on said non-contact surface.

The said first end of each said rod preferably includes a smooth-edged enlarged portion capable of releasably engaging with said first retaining means.

Preferably, said enlarged portion is releasably detachable from said rods.

Preferably, said rods are formed from pultruded fibreglass.

Preferably said second retaining means comprises a plurality of cylindrical elements attached to the perimeter of said support element.

BRIEF DESCRIPTION OF DRAWINGS

By way of example only, a preferred embodiment of the present invention is described in detail with reference to the accompanying drawings, in which.

BEST MODE FOR CARRYING OUT THE INVENTION

Figure 1:
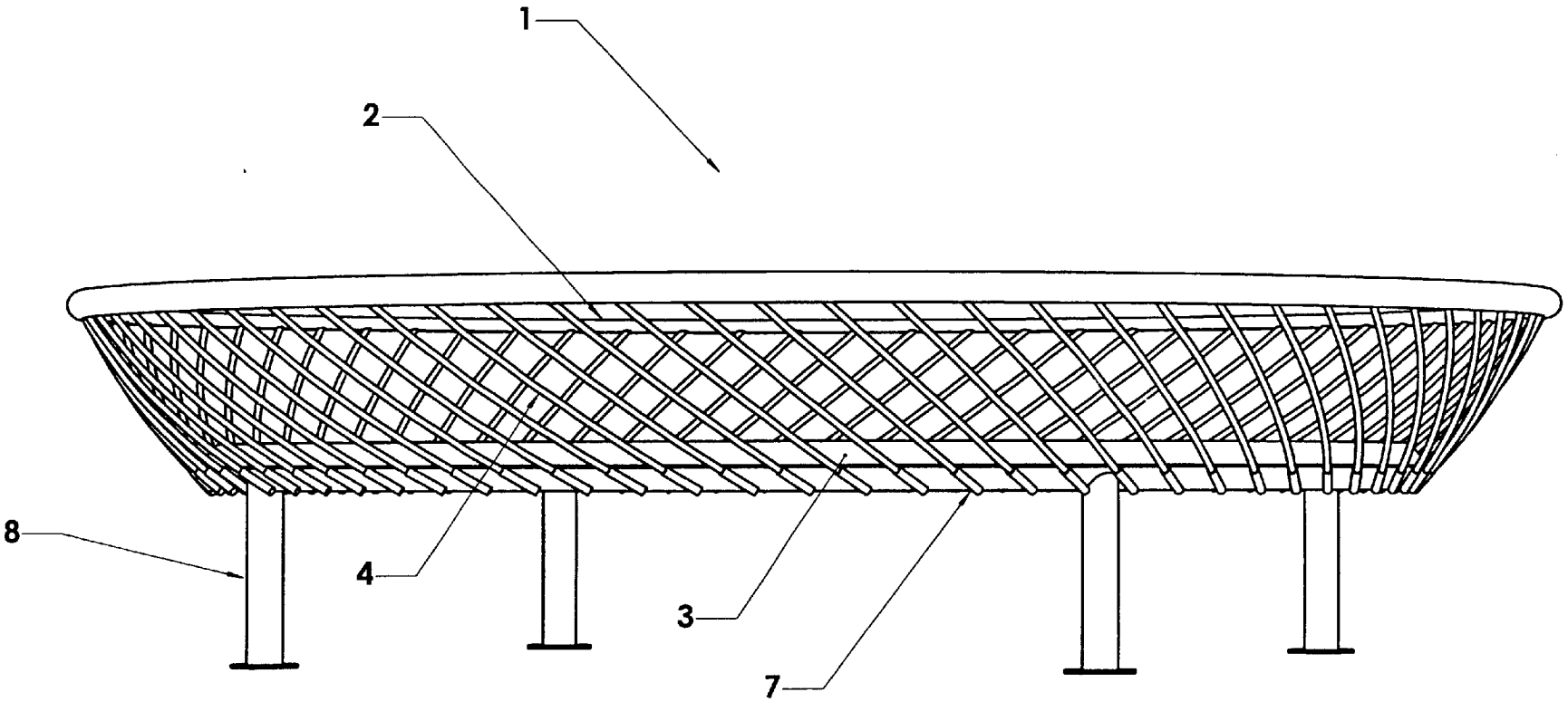
FIG. 1. shows a side elevation of a preferred embodiment of present invention, FIG. 2. shows a perspective view of the preferred embodiment shown in FIG. 1, FIG. 3. shows an enlarged cross-sectional view of a portion of the preferred embodiment shown in FIG. 1

FIGS. 1–6 show a preferred embodiment of the present invention in the form of a trampoline (1) comprised of a flexible mat (2), a support element in the form of an annular ring frame (3) and a plurality of flexible elongated rods (4) (having a first and second ends). In this embodiment, the flexible mat (2) is circular, though other shapes are also possible such as rectangular, square, pentagonal, hexagonal, heptagonal, octagonal and so forth. Equidistantly spaced about the periphery of the circular mat (2) are a plurality of first retaining means in the form of pouches (5) sewn into the fabric of the mat with an aperture formed on the lower surface of said mat (2). The flexible mat (2) is tensioned during assembly by bending the top ends of the rods (4) inwards towards the trampoline centre and connecting them to the said pouches (5). This forms a horizontal planar surface (when the trampoline is used on a horizontal surface), the upper surface of which provides a bouncing surface for the user.

Figure 4:
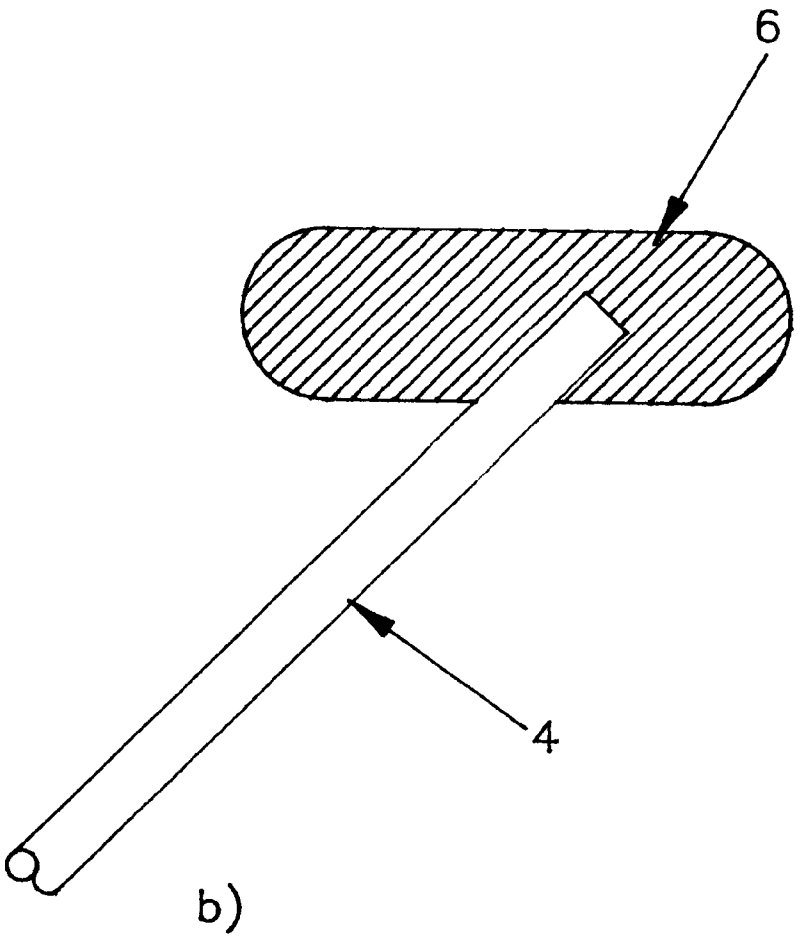
FIG. 4. shows an enlarged side elevation view of alternative embodiments of the rod end pieces, FIG. 5. shows an enlarged side elevation view of a portion of FIG. 1 and FIG. 6. shows a cross-sectional view through the line XY shown on FIG. 5.
Figure 4:
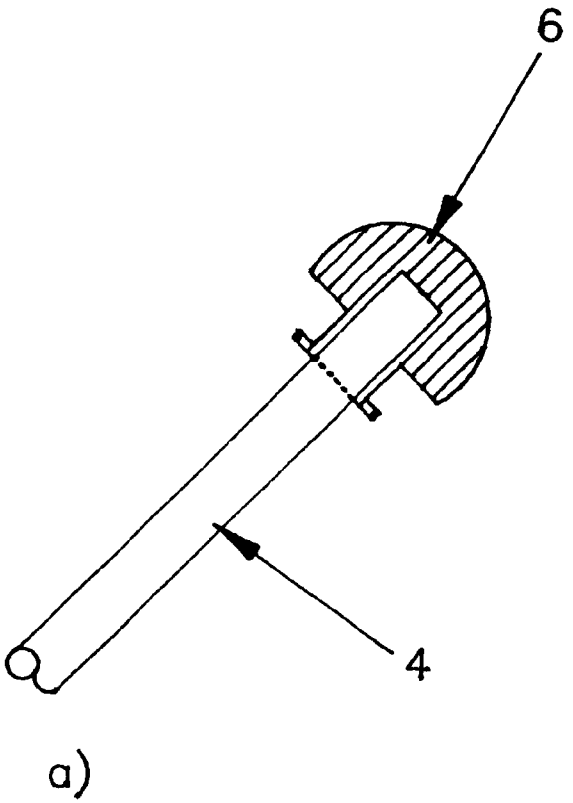

The rods (4) may be made of any suitably resilient material, though in practice it has been found advantageous to use pultruded fibreglass of circular cross-section. The rods (4) are each equipped at a first end with a protective end-piece (6), as shown in two alternative embodiments in FIG. 4. The end-pieces (6) are configured to be releasably inserted and retained within pouches (5). FIG. 4 *a*) shows a hemispherical dome-shaped end-piece (6) attached to the end of a rod (4) via a cylindrical sleeve and collar extending from the flat side of the hemisphere, whilst FIG. 4 *b*) shows an alternative round edged oblong/lozenge shaped end-piece (6). The sleeve/collar arrangement shown in FIG. 4 *a*) is used to attach the end piece (6) to the mat (2) by a strap (not shown) in order to alleviate the load on the pouch (5). Both the end-pieces (6) shown are exemplary and alternative shapes may be employed providing they afford a secure means of retaining a rod (4) within a pouch (5) whilst under tension, without damage the mat (2) or its surrounds and prevent injury to a user falling on the trampoline edge.

Figure 2:
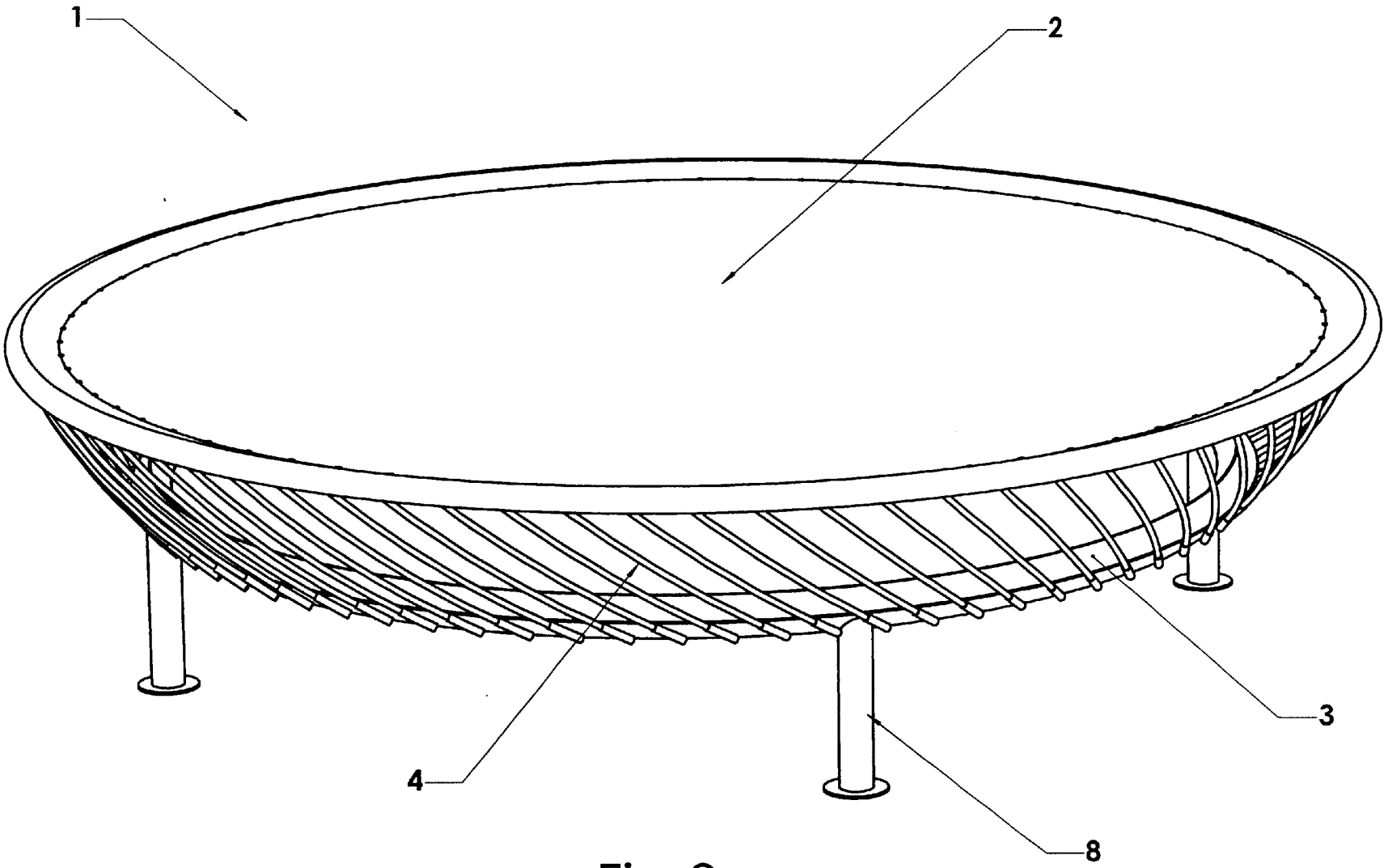
Figure 6:
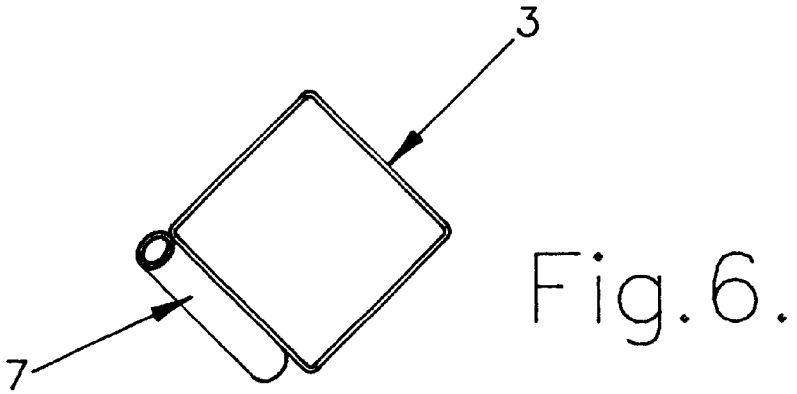
Figure 5:
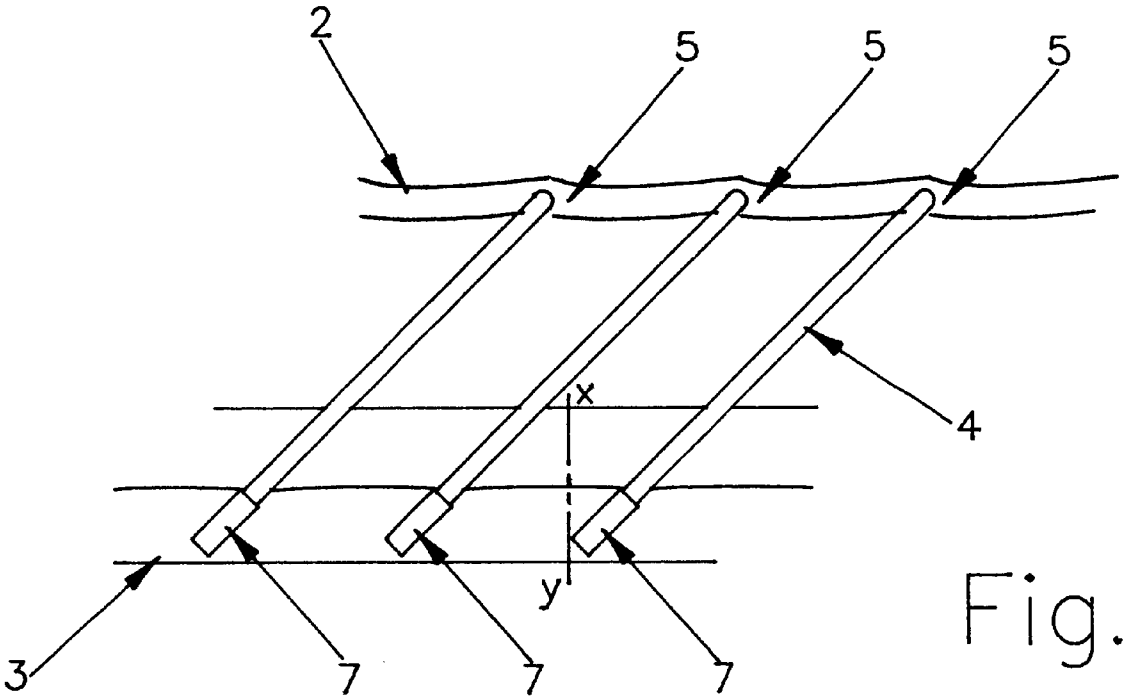

The said second end (i.e. the opposing end to the said first end with the attached end-piece (6)) of each rod (4) is inserted into a second retaining means in the form of a tubular cylindrical holder (7), which is closed (or pinched) at one end. To assemble the trampoline (1), the said second ends of the rods (4) are inserted into the respective holders (7) and the end-pieces (6) (attached to the said first ends of the rods (4)) are inserted into the corresponding apertures of the pouches (5). As shown in FIGS. 1, 2, and 5, the holders (7) are arranged around the outside perimeter of the circular ring frame (3), which is formed (in the embodiment shown in the drawings) from interconnecting lengths of square-sectioned steel framework, orientated such that the diagonally opposing cross-sectional apexes are aligned vertically and horizontally respectively. The holders (7) are attached (with the open end of the holder (7) uppermost) to the lower outward facing surface of the square-sectioned ring frame (3), as shown in FIG. 6. Each holder (7) is orientated such that the longitudinal axis of the cylindrical holder (7) is simultaneously inclined upwards and outwards (in radial direction) and approximately tangentially (with respect to the perimeter of the ring frame (3)). Thus, the rods (4) inserted into the holders (7) are also orientated outwards and sideways (as viewed in side elevation) from the holders (7) towards the perimeter of the mat (2).

In an alternative embodiment (not shown), the ring frame (3) may be formed from circular cross-section tubing, with the holders (7) secured (e.g. by welding) about the outer perimeter of the ring frame (3) as described above. In either embodiment, the holders (7) may alternatively be secured on the interior perimeter of the ring frame (3). This configuration prevents a user impacting on the top of the ring frame (3) itself during particularly vigorous/energetic bouncing.

Figure 3:
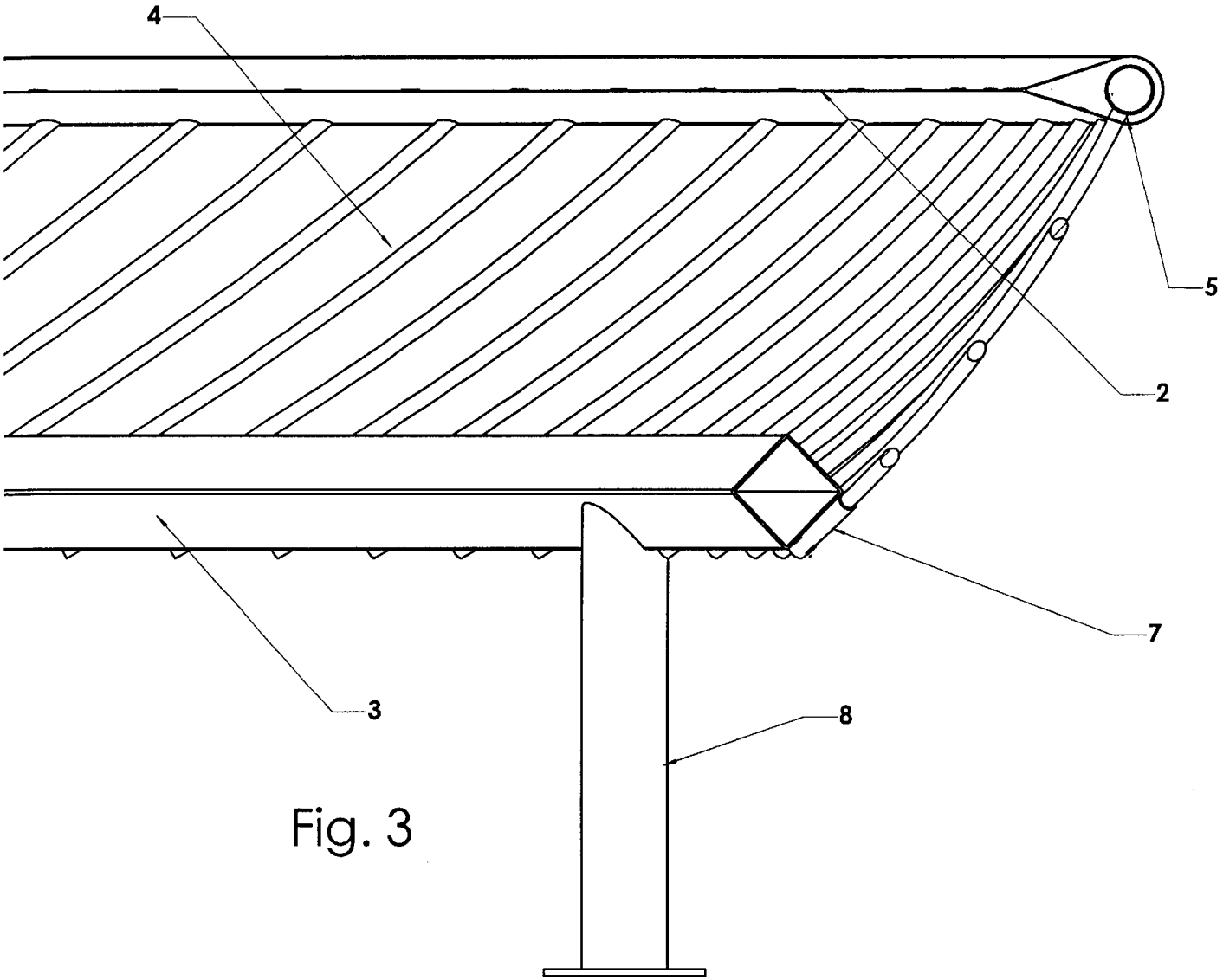

The mat (2) is diametrically larger than, and located concentrically above, the said ring frame (3). This configuration (as shown in FIGS. 1–3) produces an inverted frustroconical shaped trampoline, with the rods (4) arranged in an outwardly inclined swirl pattern. When a user bounces down on the upper contact surface of the mat (2), the vertical displacement of the mat (2) flexes the top section of the rods (4) inwards towards the impact point generating an opposing tension in the rods (4). After the point of maximum vertical deflection of the mat (2) has been reached, the tension in the flexed rods (4) causes them to spring radially outwards towards their original position, providing the desired upwards movement of the mat (2), i.e., bounce. This bouncing mechanism could be achieved by orientating the rods (4) such that their longitudinal axis extended radially outwards (with respect to the geometric centre of the trampoline) at an upwards incline from the ring frame (3) (i.e. no 'swirl' pattern), or even by rods (4) orientated vertically upright. However, such configurations could lead to user injury and/or trampoline damage in the event of an impact directly on top of a rod/end-piece assembly (2,6). This may be averted by inclining the rods (4) in a substantially tangential direction to the perimeter of the mat (2) as well as in the radial direction. Thus, in the event of such an impact, the rods (4) immediately below and adjacent to the impact point on the mat (2) are readily deflected downwards without causing injury as the force of the impact acts laterally on the side of the rods (4) instead of along the stiffer longitudinal axis.

Although the ring frame (3) may be placed directly on the ground to form a base, in the preferred embodiment shown in the drawings, the frame (3) is supported above the ground by a number of the legs (8) extending vertically downwards from the lower surface of frame (3). It will be appreciated that the purpose of the ring frame (3) is to provide a suitably robust and rigid means of locating and orientating the ends of the rods (4) and in this may be provided by a variety of alternative configurations. Furthermore, the trampoline is able to flex horizontally in the event of an inadvertent impact from the side.

As a result of the innovative design of the present invention, the bouncing surface of the mat (2) extends across the entire upper surface of the trampoline (1), without any exposed springs or rigid bars/frameworks capable of injuring the user. It has been found that the flexing action of the rods (4) provides a comparable performance to that of conventionally sprung trampolines. Moreover, the rods (4) provide a greater reactive force in the immediate vicinity of the mat (2) perimeter, thus causing a user bouncing near the edge to be projected towards the centre of the trampoline (1) instead of over the edge.

In the foregoing specification, the present invention has been described with reference to specific exemplary embodiments thereof. It will, however, be evident that various modifications and alterations may be made thereof without departing from the broader spirit and scope of the invention as set forth herein. The specification and drawings, are, accordingly, to be regarded in the illustrative rather than a restrictive sense.

What is claimed is:

1. A trampoline comprising a flexible mat with a plurality of first retaining means located around the mat perimeter, a plurality of second retaining means located about the periphery of a support element and a plurality of flexible elongated rods, such that in use on a flat horizontal surface, said mat forms a horizontal plane having an upper contact surface and a lower non-contact surface orientated vertically above said support element, wherein each said flexible rod is retained at a first and second end by said first and second retaining means respectively.

2. The trampoline as claimed in claim 1 wherein each said rod extends upwards from said support element at an incline.

3. The trampoline as claimed in claim 2 wherein the said rods are simultaneously inclined from said support element to intersect with the said mat perimeter at a non-orthogonal angle in both the vertical and horizontal planes.

4. The trampoline as claimed in claim 3 wherein said support element comprises a frame of the same shape in plan as said mat and is arranged centered below said mat in use.

5. The trampoline as claimed in claim 4 wherein said mat is larger in plan view than said support element.

6. The trampoline as claimed in claim 5 wherein said mat is circular.

7. The trampoline as claimed in claim 5 wherein said mat is polygonal.

8. The trampoline as claimed in claim 1 wherein said first retaining means comprises a plurality of pockets each formed with an aperture on said non-contact surface.

9. The trampoline as claimed in claim 1 wherein the first end of each said rod includes a smooth edged enlarged portion capable of releasably engaging with said first retaining means.

10. The trampoline as claimed in claim 9 wherein said enlarged portion is releasably detachable from said rods.

11. The trampoline as claimed in claim 1 wherein said second retaining means comprises a plurality of cylindrical elements attached to the perimeter of said support elements.

12. The trampoline as claimed in claim 1 wherein each said rod is formed from pultruded fibreglass.

13. A trampoline comprising:

a flexible mat a support element a plurality of spaced flexible elongated rods secured between said mat and said support element so as to support said mat above said support element.

* * * * *